US005655897A

United States Patent [19]

Neftel et al.

[11] Patent Number: 5,655,897

[45] Date of Patent: Aug. 12, 1997

[54] PERISTALTIC PUMP CASSETTE

[75] Inventors: Frederic Neftel, Paris; Bernard Bouvier, Eragny-Sur-Oise, both of France

[73] Assignee: Debiotech S.A., Lausanne, Switzerland

[21] Appl. No.: 591,541

[22] PCT Filed: Aug. 3, 1994

[86] PCT No.: PCT/FR94/00976

§ 371 Date: Mar. 28, 1996

§ 102(e) Date: Mar. 28, 1996

[87] PCT Pub. No.: WO95/04886

PCT Pub. Date: Feb. 16, 1995

[30] Foreign Application Priority Data

Aug. 6, 1993 [FR] France ..... 93/09749

[51] Int. Cl.[6] ..... F04B 43/12

[52] U.S. Cl. ..... 417/477.2; 417/477.6

[58] Field of Search ..... 417/477.2, 477.6

[56] References Cited

U.S. PATENT DOCUMENTS 4,702,679 10/1987 Malbec ..... 417/477.6

FOREIGN PATENT DOCUMENTS

| | | |
|---|---|---|
| 2 288 238 | 5/1976 | France . |
| 2 383 333 | 10/1978 | France . |
| 2 595 765 | 9/1987 | France . |
| 2 644 212 | 9/1990 | France . |
| 2 644 522 | 9/1990 | France . |
| 2 690 715 | 11/1993 | France . |
| 915959 | 1/1963 | United Kingdom . |

*Primary Examiner*—Richard E. Gluck
*Attorney, Agent, or Firm*—Young & Thompson

[57] ABSTRACT

A peristaltic pump cassette (1) is designed to cooperate in use with a motor unit (2) through a drive spindle (30) comprising a casing (40) with a tube bearing surface (12), a deformable tube (11), rotating rollers (14) driven by friction by the drive spindle (30). The deformable tube (11) is applied onto the support surface (12) and is deformed by rotating rollers (14), in order to produce driving of a liquid contained therein.

Before first use, the radial position of rollers (14) is such that the tube (11) is not closed. During first use, they are moved radially by inserting the drive spindle (30), thus closing the tube (11). After use, rollers (14) remain in the radial position that keeps the tube (11) closed.

9 Claims, 6 Drawing Sheets

PERISTALTIC PUMP CASSETTE

This invention concerns a peristaltic pump cassette that permanently closes its tube the first time that the drive spindle is inserted.

Peristaltic pumps provide a uniform and controllable flow. They are frequently used particularly for medical purposes, for example to control injections.

Peristaltic pumps are frequently provided with a cassette designed to cooperate with the spindle of a motor which drives mobile components by friction.

This type of cassette includes a casing, a deformable tube and rotating rollers.

The deformable tube forms a loop in a plane applied to a bearing surface of the casing by rotating rollers.

These rotating rollers are driven in rotation by the motor spindle and cause deformation of the tube thus producing the required peristaltic effect.

Many publications have disclosed pumps and peristaltic pump cassettes, for example:

French patent application FR-A-2.595.765 which describes and illustrates a peristaltic pump comprising at least 2 elastic tubes placed in parallel and several pressure rollers acting on these elastic tubes. The purpose of this pump is to output a uniform flow.

French patent application FR-A-2,644,212 deals with a cassette for a peristaltic pump with a deformable tube and the pump fitted with this type of cassette. The cassette includes a casing which is fitted with a cylindrical rolling track close to each of its ends, against which satellites are applied and roll compressing the deformable tube located between the two rolling tracks. The cassette described and illustrated is easy to build and is robust.

French patent application FR-A-2.644.522 concerns a peristaltic pump with deformable tube comprising independent deformable tube arcs inside the casing, which gives an instantaneous reduction in flow fluctuations. The pump is compact.

The use of peristaltic pumps with cassettes in a hospital environment can improve the safety of health care. Throw-away cassettes, separable from the motor unit, have made a significant improvement in this respect.

The use of a polarizing device to prevent a cassette from being used with a motor unit for which it is not designed, is another important step in improving reliability.

However, it was found that, when separated from its motor unit, a cassette could accumulate liquid in the tube passing therethrough, which in some cases could bring about risks. For example, a perfusion liquid could be mistakenly injected under uncontrolled conditions.

In order to solve this difficulty, it was planned to use peristaltic pump cassettes in which the deformable tube is compressed and blacked when the pump is installed. However, compressing the tube in this way at a given point continuously after mounting and before using the pump, could cause permanent deformation of the tube which could be harmful to its future use.

Therefore, the purpose of this invention is to propose a peristaltic pump cassette in which the tube is permanently blacked after its first use, regardless of its subsequent configuration and position with respect to the motor unit.

Another object of the invention is to provide this type of self-closing cassette which can be stored, after first use, without causing damage to the tube.

Yet another object of this invention is to provide a relatively easy to make self-closing peristaltic pump cassette, for which the production cost remains reasonable.

Thus, the invention concerns a peristaltic pump cassette designed to work in cooperation with a motor unit the first time that it is used, through a drive spindle comprising:

a casing with a tube bearing surface, a deformable tube, rotating rollers driven by friction by the drive spindle, the deformable tube being applied onto the support surface and deformed by rotating rollers, in order to drive the liquid contained in it.

According to the invention, before the first use the rollers are in a radial position in which the tube is not blocked: the first time that the cassette is used, the rollers are moved radially as the drive spindle is inserted, blocking the tube; after use, the rollers remain in a radial position that keeps the tube closed.

The following characteristics are possible, either separately or in all technically possible combinations, depending on the different embodiments, each of which has its own specific advantages:

the casing contains blocking means preventing removal of at least part of the drive spindle after the first time it is inserted;

the cassette includes an elastic device linked to the casing and released when the drive spindle is inserted, and holding at least one of the rollers in a radial position blocking the tube;

the rollers are free and each has a drive surface revolution delimited by two bases, and each has at least one cylinder on one of its bases; the casing includes a disk, approximately perpendicular to the drive spindle, close to the rollers, this disk being fitted with an elastic pin that bears on the bottom of the cylinder of one of the rollers before the first time the drive spindle is inserted, that is released when this spindle is inserted, and which bears against the surface of revolution of the cylinder, holding at least one roller in a radial position blocking the tube;

the disk is made of a plastic material in which the elastic pin is formed;

the elastic pin carries an abutment concentric with the drive spindle, capable of cooperating with the roller cylinder;

the abutment covers an angle exceeding 120°;

the abutment covers an angle of about 132°;

when the drive spindle is inserted into the cassette, the elastic pin is no longer in contact with the rollers;

the rollers have hubs, and the cassette contains separators onto which the rollers are fixed by their hubs, the said separators comprising initial housings in which hubs are placed before the drive spindle is inserted for the first time, and second housings more eccentric than the first housings and separated from them by an elastic abutment, the first insertion of the motor spindle into the cassette causing an irreversible movement of the hubs from the first housings towards the second housings.

The invention will be described in detail with reference to the attached drawings, in which.

Figure 1:
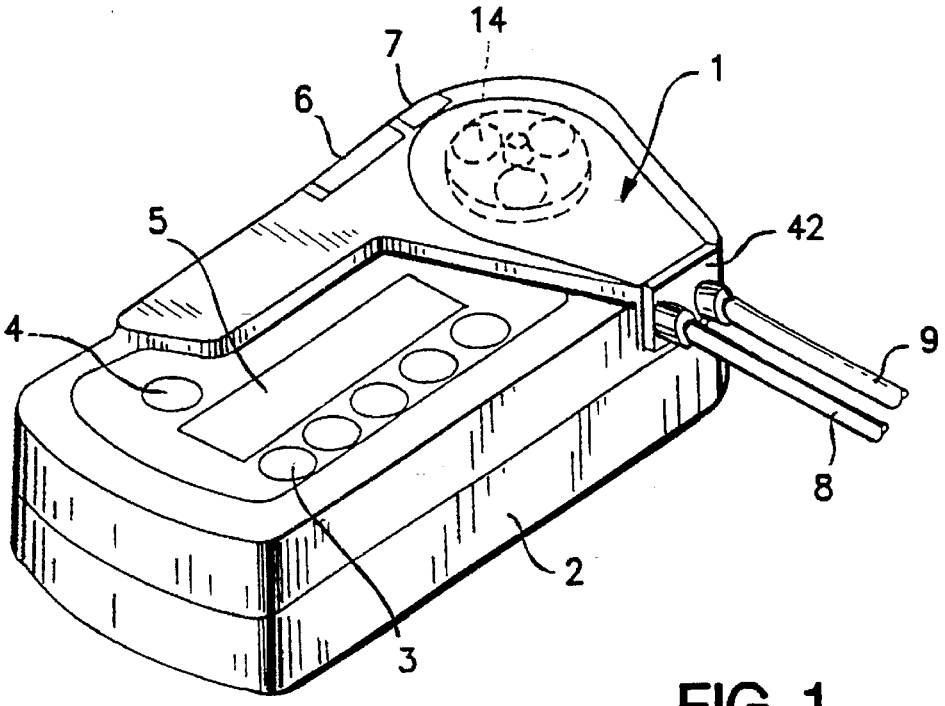
FIG. 1 PRIOR ART
FIG. 1 is a perspective view showing a general view of a peristaltic pump cassette in its position of use on the motor unit.
Figure 2:
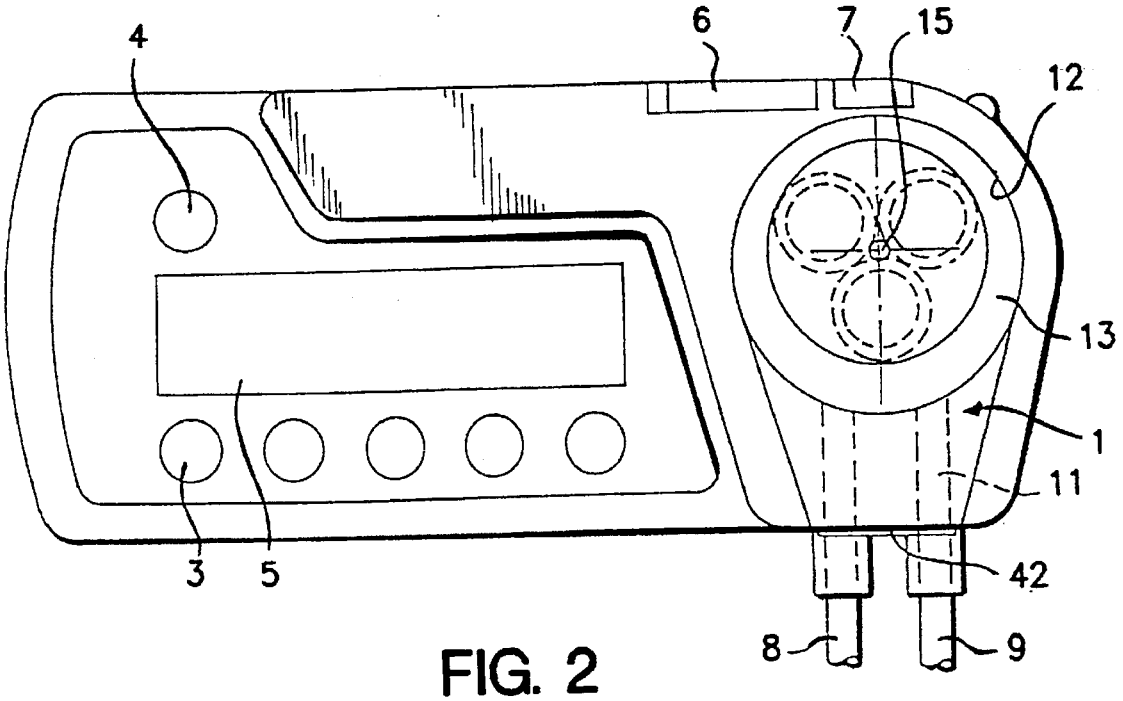
FIG. 2 PRIOR ART
FIG. 2 is a top view of the same assembly.
Figure 3:
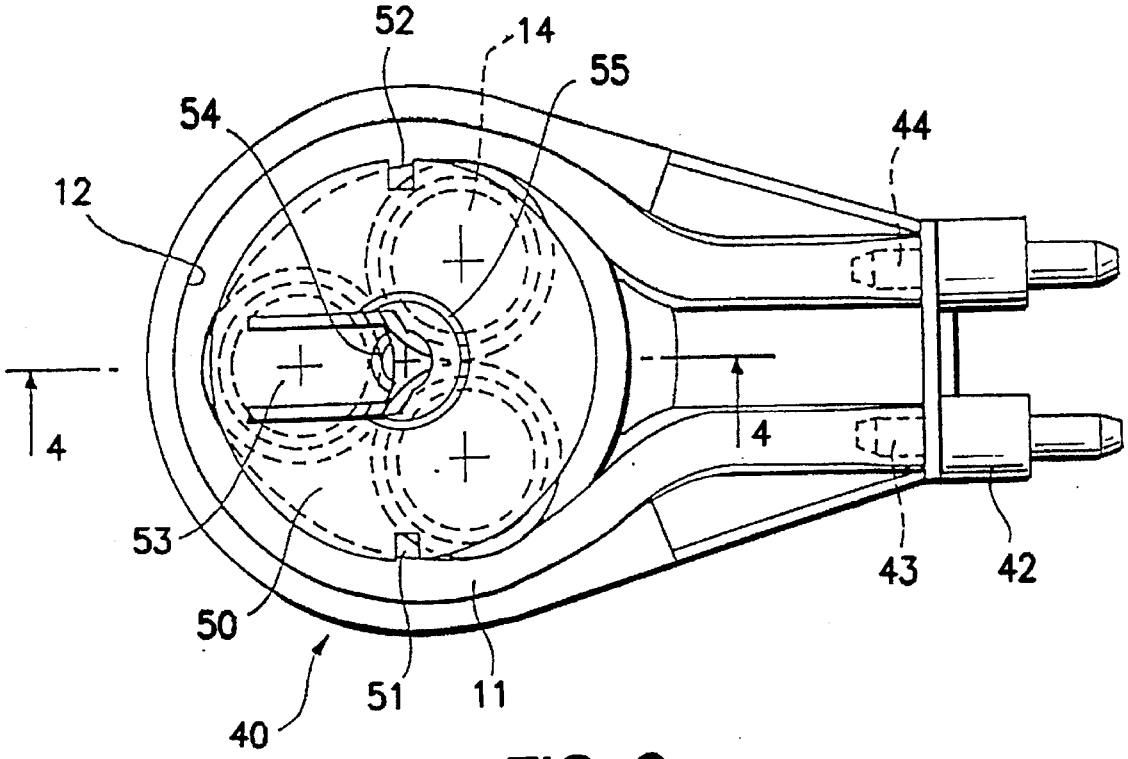
FIG. 3 is a top view of a cassette in accordance with the invention, without its front cover before being used.
Figure 4:
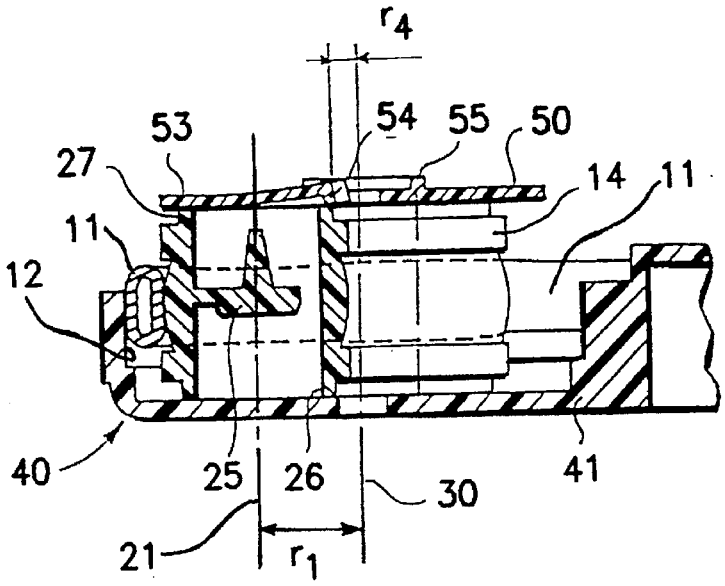
FIG. 4 illustrates section AA of the cassette in FIG. 3.
Figure 7:
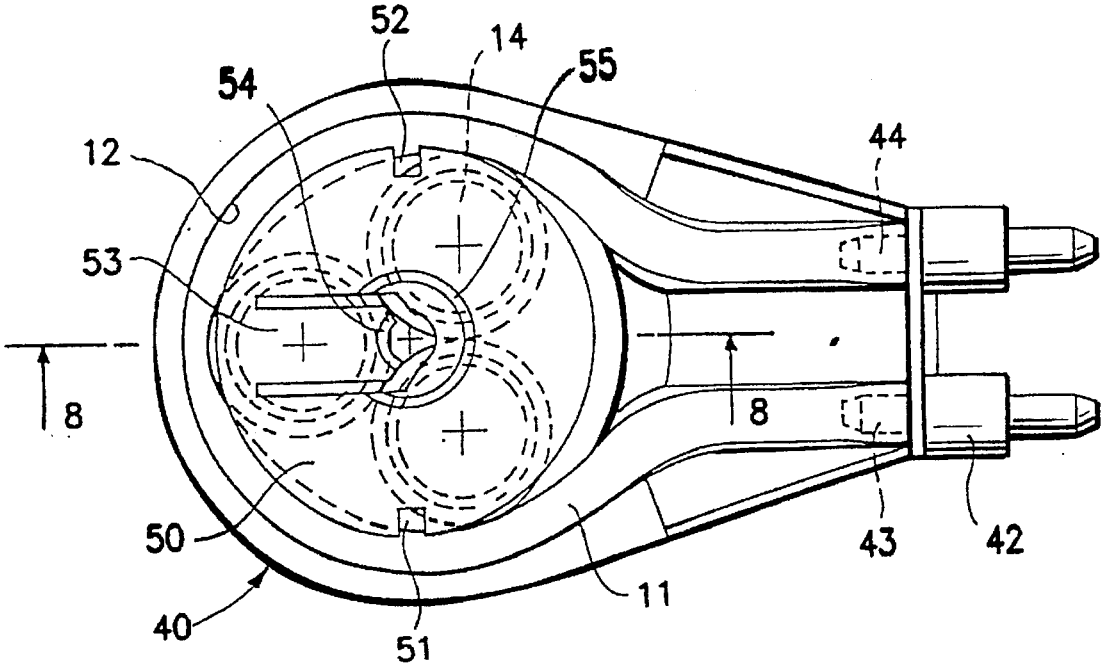
Figure 8:
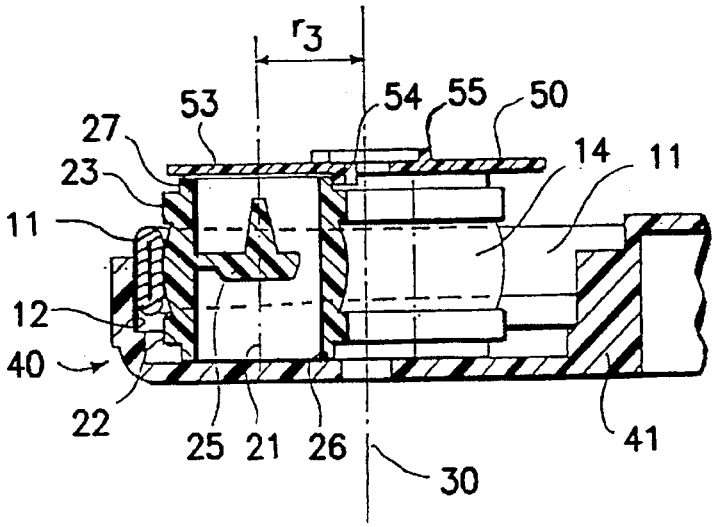
Figure 9:
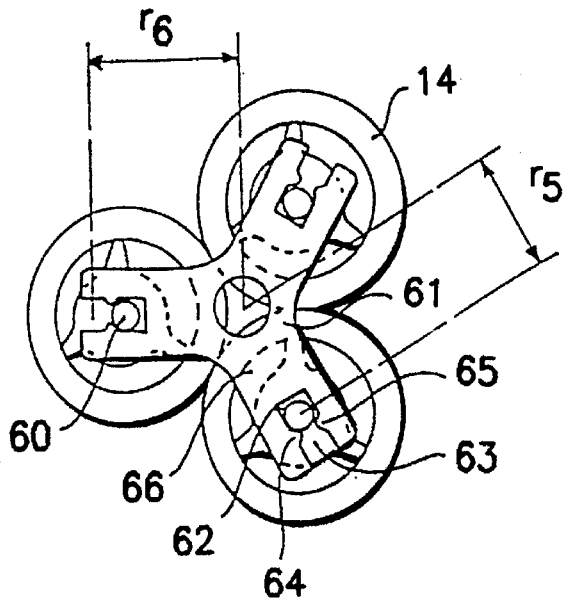
Figure 10:
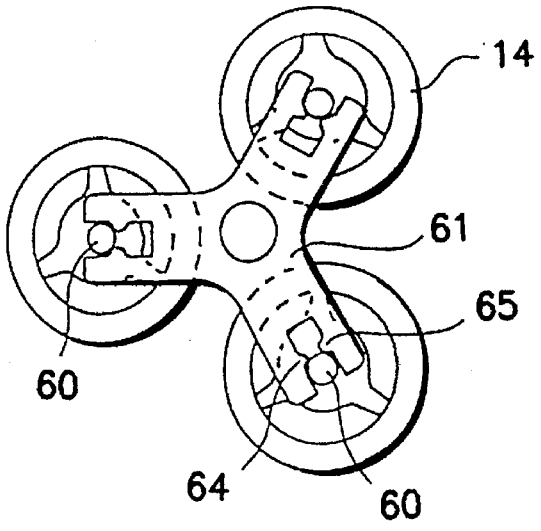

FIGS. 7 and 8 correspond to FIGS. 3 and 4 when the cassette has been separated from the drive spindle after use;

FIG. 9 shows the operation of the invention in a cassette containing separators before the first use;

FIG. 10 shows the same assembly in the presence of a drive spindle or after use.

Figure 11:
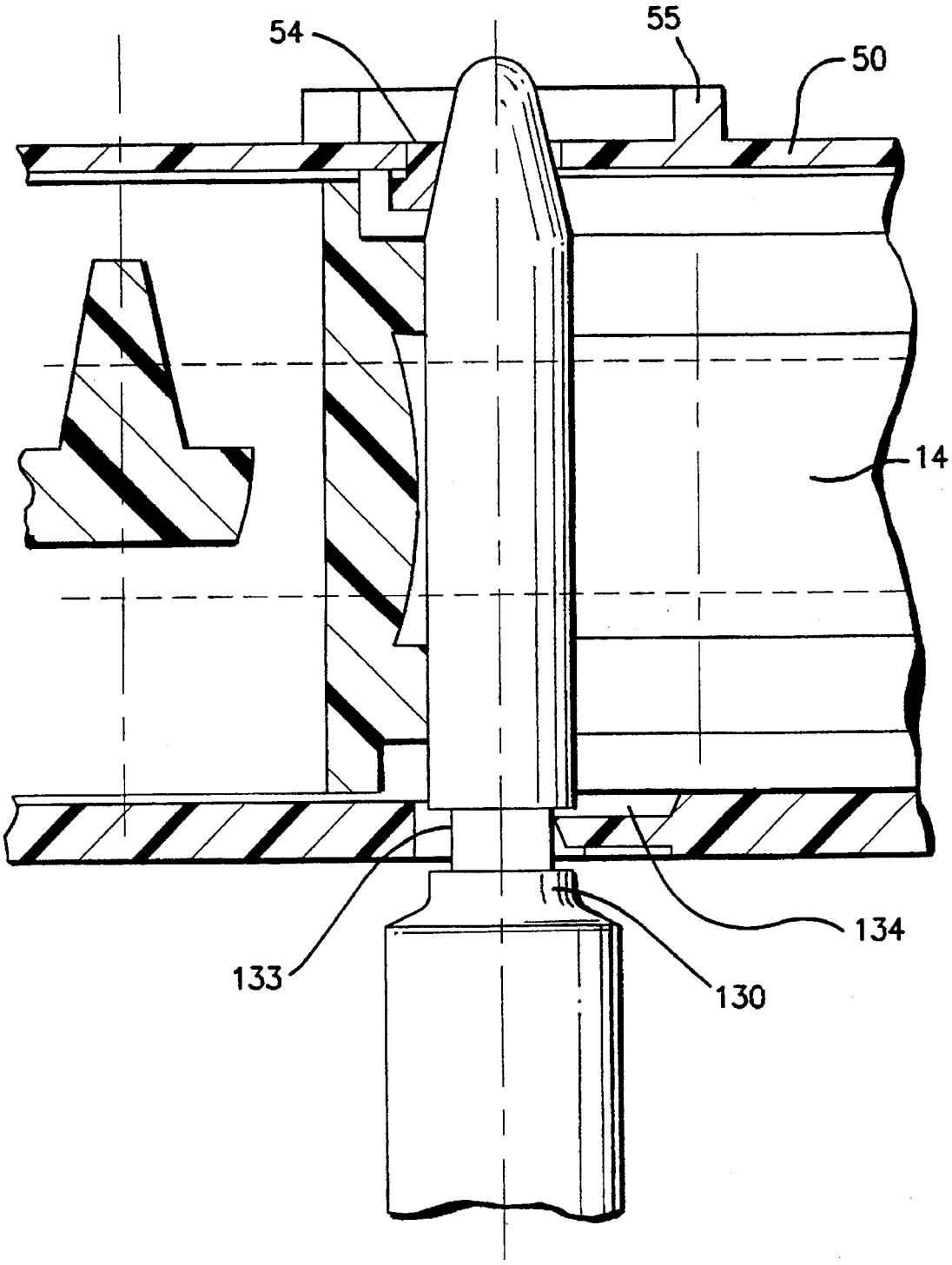

FIG. 11 shows the interaction between the drive spindle and a roller, according to one embodiment.

In use, the cassette 1 will be placed on the motor unit 2 in which a housing is formed for this purpose.

The user controls operation of the motor unit 2, using controls 3 and 4 and the display panel 5.

Buttons 6 and 7 separate cassette 1 from motor unit 2, and participate in providing the safety necessary for this operation.

Tubes 8 and 9 are pump inlet and outlet tubes respectively. For example, tube 8 could be connected to a perfusion tank, while tube 9 is connected to an injection needle.

The deformable tube 11 forms an approximately plane loop with its external surface bearing on a support surface 12 provided for this purpose in the peristaltic pump cassette 1 casing 13.

The variable number of rollers 14 (there are three shown in the figure) rotate about the axis 21 and are placed inside the loop formed by the deformable tube 11.

The drive spindle 15 parallel to the axis about which the rollers rotate, separates the rollers when it is inserted between them, forcing them to compress the deformable tube 11 against the support surface 12 thus driving them by friction.

Figure 6:
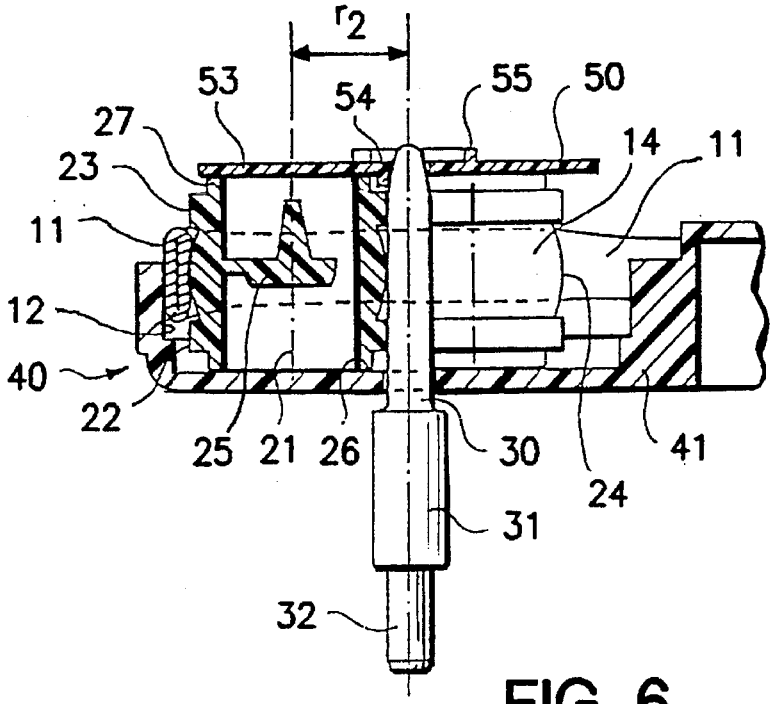

All rollers are identical, and they are described particularly with reference to FIG. 6.

Each roller has an axis of revolution 21, two cylindrical surfaces 22, 23 in contact with spindle 30, and used to drive rollers 14 by this spindle 30.

A bearing surface 24 on spindle 21 which is preferably barrel-shaped, in other words convex outwards, is designed to cause compression of deformable tube 11. The central element 25 is made during the roller manufacturing process 14 and does not directly participate in the device and its operation as described here.

The roller 14 is fitted with one cylinder 26, 27 at each of its ends, and with a spindle 21 with a diameter less than cylinders 22 and 23.

The roller spindle 21 is of course parallel to the drive spindle 30. The radial distance between rollers is equal to the distance r, shown as r1, r2, r3 in the various figures.

The peristaltic pump cassette contains a casing 40 formed from a base 41 and a cover.

The cover is not shown for reasons of clarity. It generally click fits onto base 41 and helps to hold the elements contained in cassette 40 in place.

When the pump is being assembled, the deformable tube 11 is connected to a guide tube 42 to which it is fixed by male elements 43 and 44.

The deformable tube 11 thus forms a loop which is approximately planar and is positioned inside casing 40, and bears on the bearing surface 12.

Rollers 14 are then inserted inside the closed loop. Their diameter is such that they come into contact with each other and slightly deform tube 11. By elasticity, tubing 11 pushes the rollers inwards to come into contact with each other.

If there is no drive spindle, tube 11, as shown in the section in FIG. 4, is only partially deformed. The dimensions of the casing and of the rollers are determined such that the tube is not completely blacked.

In this state, the small deformation of the deformable tubing 11 in no way impairs its subsequent usage, regardless of the storage duration for which it is kept in this state. However, since it is only slightly deformed, it is not blacked and could thus passively allow passage of a fluid pressurized at one of its ends.

Figure 5:
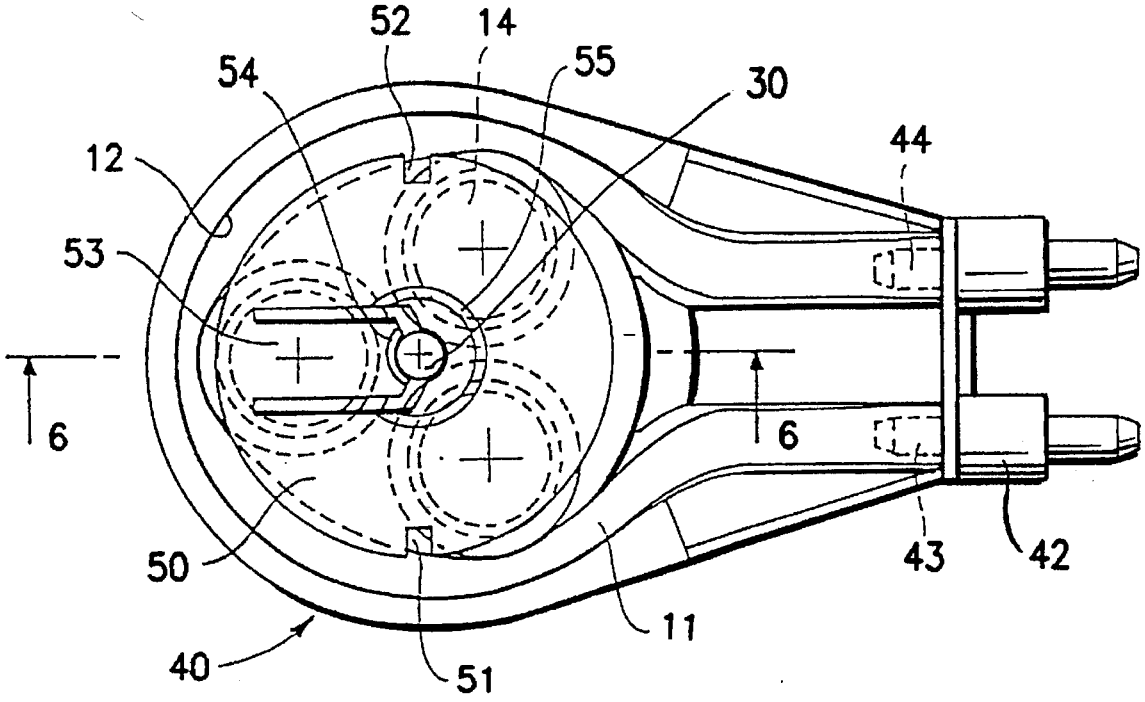
FIGS. 5 and 6 are views corresponding to FIGS. 3 and 4, when the cassette is working with the drive spindle.

Inserting the drive spindle 30 as shown in FIGS. 5 and 6 separates the rollers from the center and compresses the tubing 11 between the casing bearing surface 12 and the roller support surface 24.

This compression completely blacks the tubing.

Furthermore, this compression exerts an elastic force applying rollers 14, and particularly their cylindrical sections 22, 23 on to the drive spindle 30.

Thus, when this drive spindle 30 rotates, the rollers 14 are driven by friction.

They rotate about themselves and their axis of rotation itself rotates about the drive spindle 30.

When known cassettes are used, separation of the cassette from the drive spindle 30 returns the various component elements of the cassette to their initial state, shown in FIGS. 3 and 4, due to the elasticity of the tube 11 which returns to its initial shape and pushes the rollers into contact with each other.

Since pipe 11 is no longer blacked, it may allow the liquid contained in it to circulate, for example when there is a pressure difference between the inlet pipe 8 and the outlet pipe 9.

In one first embodiment of the invention, the cassette casing 40 comprises an elastic component, not shown, that cooperates with the rotation spindle 30 so that it can no longer be extracted once it has been inserted in position in the cassette. As shown in FIG. 11, this could be an elastic pin 134 fixed at the bottom of the casing and cooperating with a groove 133 formed in the drive spindle 130.

Thus, the elastic tube 11 is permanently blacked when the rotation spindle 30 is inserted, which itself is permanent.

In this case, the drive spindle 30 must be replaced every time the cassette is changed. The motor spindle 32, rigidly attached to the motor unit 2, then includes a coupling device 31 to form the junction with the drive spindle 30.

In a second preferred embodiment, the casing 40 is equipped with a disk 50 positioned with respect to the disk by notches 51, 52 and comprising an elastic pin 53, possibly fitted with an abutment 54, capable of cooperating with the cylinder 27 of rollers 14.

A ring 55 provided on disk 50 positions it with respect to casing 40.

Abutment 54 is concentric with the drive spindle 30.

Its radial position, defined by its distance r4 from spindle 30, is such that when rollers 14 are in the assembled position, in which tubing 11 as described above is slightly deformed, this cylindrical stop bears against one of the bases of at least one of the rollers 14. Thus, these rollers 14 are free and are positioned solely by the effect of the elastic return force produced by tubing 11 and by their dimensions.

When the drive spindle 30 is inserted, rollers 14 are pushed back as described above towards the outside of the cassette, allowing engagement of the stop 54 at the cylindrical part 27 of roller 14, as shown in FIG. 6.

Thus, when the drive spindle 30 is taken out as shown in FIGS. 7 and 8, roller 14, tending to return to the position in which it was initially installed under the action of the elastic force exerted by the deformable tube 11, is prevented from doing so by abutment 54. Thus, tube 11 remains closed, even in the absence of drive spindle 30.

In order to prevent possible disturbances to the movement of rollers 14 when the pump is being used, the size of abutment 54 is such that it is kept at a distance without contact with cylinder 27, when the drive spindle 30 is in position.

The cassette in the invention as described up to now and as shown in FIGS. 3 to 8, only comprises a single disk placed close to one of the bases of rollers 14.

However, this type of disk could be provided on each base, above and below the rollers.

The angular dimension of the abutment 54 is determined such that, regardless of the position of the rollers inside the cassette, at least one is supported on this stop thus blocking tube 11, resulting in the greatest possible safety. This result is obtained with an angular abutment 54 extending over an angle of at least 120° and preferably equal to about 132°.

During assembly, the rollers are positioned at a distance r1 from the drive spindle 30. When the drive spindle 30 is inserted, their radial position becomes r2 and when it is removed, the radial position of rollers 14 becomes r3. r2 is greater than r1 and movement of the rollers in this position completely blacks the deformable tube 11. r3 is also greater than r1 and when rollers 14 occupy the corresponding position, the tube 11 is also completely blacked. However, r3 is slightly less than r2 in order to limit friction forces caused by disk 50 during operation of the cassette.

Another embodiment of the invention is proposed in which rollers comprise hubs 60 and are kept in place by separators 61.

This embodiment is shown in FIGS. 9 and 10. Only the separators and rollers are shown, other elements of the cassette being similar to those described above.

In this case, separator 61 contains a first housing 62 for each roller 14 corresponding to a first radial position r5 of the rollers, and a second housing 63 corresponding to a second radial position r6 of the rollers.

These first housings 62 and second housings 63 are separated by abutments 64, 65, forming a space with dimensions less than the diameter of hub 60. These first and second housings thus form an element at the end of each arm 66 of the separator 61 that deforms when pressure is exerted by hub 60. This deformation enables hub 60 to move from the first housing 62 to the second housing 63.

The radial distance r6 of the second housing 63 is greater than the radial distance r5 of the first housing 62.

When the cassette is installed, hubs 60 and rollers 14 are in position in the first housings.

When drive spindle 30 is inserted between the rollers, it exerts a pressure on hubs 60, forcing them to move by elastic deformation from the end of arms 66 towards the second housings 63.

When the drive spindle 30 is extracted, the elastic return force exerted by the deformable tubing 11 is insufficient to return the hubs into the first housings 62.

Thus, the hubs remain in position in the second housing 63 and continue to black tube 11.

In this description, the axis about which the roller rotates has been referred to as drive spindle 30 as if it were a physical element, and also to define its theoretical position, even when the pump is dissociated from its motor unit and therefore when the spindle is not present.

While modifications of the present invention will no doubt be apparent to a person of ordinary skill in the art to which the invention pertains, it is to be understood that the embodiments shown and described by way of illustration are by no means intended to be considered in a limiting sense. Accordingly, it is intended that the claims to cover all modifications of the invention which fall within the spirit and scope of the invention.

Reference symbols inserted after the technical characteristics mentioned in the claims are only given in order to facilitate understanding, and in no way limit the scope.

We claim:

1. Peristaltic pump cassette (1) designed to cooperate with a motor unit (2) through a drive spindle (30) when in use, comprising:

a casing (40) with a tube bearing surface (12), a deformable tube (11), rotating rollers (14) driven by friction by the driving spindle (30), deformable tube (11) being applied to the bearing surface (12) and deformed by the rotating rollers (14), in order to produce driving of the liquid contained therein, characterized in that:

before the first use, the radial position of the rollers (14) is such that the tube (11) is not closed, during the first use, they are radially moved as the drive spindle (30) is inserted, thus closing the tube, after use, the rollers (14) are kept in a radial position closing the tube.

2. Cassette according to claim 1, wherein the casing (40) contains an elastic pin fixed at the bottom of said casing and cooperating with a groove formed in said drive spindle, preventing removal of at least part of the drive spindle (30), after its first insertion.

3. Cassette according to claim 1, wherein it includes an elastic device linked to the casing (40), released by insertion of the drive spindle (30) and holding at least one of the rollers (14) in a radial position blocking the tube (11).

4. Cassette according to claim 3, characterized in that the rollers (14) are free, each has a drive surface of revolution (24) delimited by at least one base and each being fitted with at least one cylinder at one of its bases, and in that the casing comprises a disk (50) approximately perpendicular to the drive spindle (30) close to the rollers (14), the said disk being fitted with an elastic pin bearing on the cylinder (27) of one of the rollers before the first insertion of the drive spindle, released when the drive spindle is inserted and bearing on the surface of revolution of the cylinder (27), holding at least one roller in a radial position that closes the tube.

5. Cassette according to claim 4, characterized in that the disk (50) is made of plastic in which the elastic pin (53) is formed.

6. Cassette according to claim 4 characterized in that the elastic pin (53) supports a concentric abutment (54) on the drive spindle, and capable of working in conjunction with the cylinder (27) of rollers (14).

7. Cassette according to claim 6, characterized in that this abutment (54) covers an angle exceeding 120°.

8. Cassette according to claim 4 characterized in that when the drive spindle (30) is inserted in the cassette, the elastic pin (53) is not in contact with the rollers (14).

9. Cassette according to claim 3, characterized in that the rollers (14) have hubs (60), and the cassette contains separators (66) on which the rollers are fixed by their hubs (60), the said separators containing first housings (62) in which hubs (60) are positioned before first insertion of the drive spindle (30), and second housings (63) more eccentric than the first housings and separated from them by an elastic abutment (64, 65), the first insertion of the drive spindle (30) into the cassette producing irreversible displacement of the hubs from the first housings (62) into the second housings (63).

* * * * *